US010988946B2

(12) United States Patent
Karlsson

(10) Patent No.: US 10,988,946 B2
(45) Date of Patent: Apr. 27, 2021

(54) KNOT PLATE FOR A TYING MACHINE AND A TYING MACHINE COMPRISING THE KNOT PLATE

(71) Applicant: HUSQVARNA AB, Huskvarna (SE)

(72) Inventor: Magnus Karlsson, Ljungbyholm (SE)

(73) Assignee: HUSQVARNA AB, Huskvarna (SE)

( * ) Notice: Subject to any disclaimer, the term of this patent is extended or adjusted under 35 U.S.C. 154(b) by 223 days.

(21) Appl. No.: 16/077,168

(22) PCT Filed: Feb. 9, 2017

(86) PCT No.: PCT/SE2017/050129
§ 371 (c)(1),
(2) Date: Aug. 10, 2018

(87) PCT Pub. No.: WO2017/138879
PCT Pub. Date: Aug. 17, 2017

(65) Prior Publication Data

US 2019/0024396 A1 Jan. 24, 2019

(30) Foreign Application Priority Data

Feb. 12, 2016 (SE) ..... 1650186-8

(51) Int. Cl.
*B65B 13/28* (2006.01)
*E04G 21/12* (2006.01)
(Continued)

(52) U.S. Cl.
CPC ..... *E04G 21/123* (2013.01); *B21F 7/00* (2013.01); *B21F 15/04* (2013.01); *B65B 13/285* (2013.01)

(58) Field of Classification Search
CPC ..... E04G 21/122; E04G 21/123; B21F 7/00; B21F 15/04; B65B 13/285; B65B 13/28
(Continued)

(56) References Cited

U.S. PATENT DOCUMENTS 567,367 A * 9/1896 Truelson ..... F16G 11/12 242/388.2
4,508,030 A * 4/1985 Grenon ..... B65B 13/28 100/26
(Continued)

FOREIGN PATENT DOCUMENTS

CN 1184521 A 6/1998
CN 1688481 A 10/2005
(Continued)

OTHER PUBLICATIONS

International Type Search Report for Swedish Application No. 1650186-8 dated Aug. 25, 2016.
(Continued)

*Primary Examiner* — Adam J Eiseman
*Assistant Examiner* — Dylan Schommer
(74) *Attorney, Agent, or Firm* — Burr & Forman, LLP

(57) ABSTRACT

A knot plate (1) for a tying machine (3) is described. The knot plate (1) is designed as a substantially circular disc, wherein the knot plate (1) comprises: an aperture (5) arranged substantially in the middle of the knot plate (1), wherein the aperture (5) comprises a substantially circular form, and two through slots (7, 9) for receiving of a binding wire (11) arranged in the knot plate (1) substantially on opposite sides of each other in relation to the aperture (5). The knot plate (1) comprises two grooves (13, 15) for receiving the binding wire, wherein each of the two grooves (13, 15) connects one respective through slot (7, 9) of the two through slots (7, 9) with the aperture (5), each of the two grooves (13, 15) ends in the aperture (5) in a direction that coincides with substantially tangential directions of the aperture (5) so that initially the binding wire substantially follows a wall of the substantially circular formed aperture
(Continued)

(5). A tying machine (3) comprising a knot plate (1) is also described.

13 Claims, 3 Drawing Sheets

(51) Int. Cl.
*B21F 7/00* (2006.01)
*B21F 15/04* (2006.01)

(58) Field of Classification Search
USPC ..... 140/118, 93.6, 101, 119, 149
See application file for complete search history.

(56) References Cited

U.S. PATENT DOCUMENTS

| | | | | |
|---|---|---|---|---|
| 5,217,049 | A | 6/1993 | Forsyth | |
| 5,842,506 | A | 12/1998 | Peters | |
| 5,983,473 | A | 11/1999 | Yuguchi et al. | |
| 7,140,400 | B2 | 11/2006 | Yokochi et al. | |
| 8,281,712 | B1 * | 10/2012 | Hoffa | B21F 15/04 100/31 |
| 8,844,434 | B2 * | 9/2014 | Barnes | E04G 21/123 100/31 |
| 9,255,415 | B2 * | 2/2016 | Gregersen | B65B 13/22 |
| 9,593,496 | B2 * | 3/2017 | Coles | B65B 13/285 |
| 2011/0155277 | A1 | 6/2011 | Coles et al. | |

FOREIGN PATENT DOCUMENTS

| | | | |
|---|---|---|---|
| SE | 512 867 | C2 | 5/2000 |
| WO | 96/00135 | A1 | 1/1996 |
| WO | 00/36249 | A1 | 6/2000 |
| WO | 2007/042785 | A1 | 4/2007 |
| WO | 2008/062213 | A1 | 5/2008 |

OTHER PUBLICATIONS

International Search Report and Written Opinion for International Application No. PCT/SE2017/050129 dated Apr. 19, 2017.
International Preliminary Report on Patentability for International Application No. PCT/SE2017/050129 dated Aug. 14, 2018.

* cited by examiner

KNOT PLATE FOR A TYING MACHINE AND A TYING MACHINE COMPRISING THE KNOT PLATE

TECHNICAL FIELD

Tying machines are used for example within building industry for binding together elongated objects with a binding wire, especially for binding together reinforcing bars. This invention relates to a knot plate for a tying machine and to a tying machine comprising said knot plate.

BACKGROUND

Traditionally, tying of for example reinforcing bars for molding of concrete elements has been done by simple, manually operated tools which is very time consuming and thereby expensive. Manually operated tying tools may also cause users repetitive strain injuries when using such a manually operated tool. Therefore, tying machines has been developed making a tying process considerably more efficient and that considerably decrease the risk for repetitive strain injuries.

Usually, a tying machine comprises two claws with guiding surfaces for a tying binding wire, which claws are placed at for example reinforcing bars to be bound together by the binding wire being fed along a guiding surface of one of the claws and over to a guiding surface of the other claw to get around the reinforcing bars. A tying machine usually comprises a knot plate rotatable arranged at the machine, which knot plate comprises an aperture in the middle of the knot plate and slots for receiving the tying binding wire. After the binding wire has been wrapped around the bars the binding wire is tightened with a predetermined force and with a mechanism inside the machine so the binding wire is guided into the slots of the knot plate. When the knot plate starts to rotate the binding wire extends from the slots above the knot plate so that a knot is formed in the middle of the knot plate during rotation of the knot plate.

Document WO2007042785 shows an example of a tying machine as described above, the tying machine comprises a knot plate with an opening arranged in the middle of the knot plate and two slots for receiving of a binding wire. A disadvantage with the knot plate in the document is that the binding wire is exposed to significant tension- and friction forces that may cause breaking of the binding wire during rotation of the knot plate. In the light of the above there is a need of an improved knot plate for a tying machine.

SUMMARY

An object of the invention is to provide an improved knot plate for a tying machine.

According to an aspect of the invention the object is achieved by a knot plate for a tying machine, wherein the knot plate is designed as a substantially circular disc and wherein the knot plate comprises an aperture arranged substantially in a middle of the knot plate, and two through slots for receiving a binding wire arranged in the knot plate substantially on opposite sides of each other in relation to the aperture, wherein the knot plate comprises two grooves for receiving the binding wire, wherein each of the two grooves, connects one respective through slot of the two through slots with the aperture.

Because the knot plate comprises two grooves for receiving the binding wire where each of the two grooves connects one respective through slot of the two through slots with the aperture, the binding wire will be guided within the grooves towards the aperture during a tying process with the knot plate. Thereby an improved control of a movement of the binding wire during the tying process is achieved. Because the binding wire is guided within the grooves during the tying process, instead of extending above the knot plate as in the case of the previous known and described knot plate, both tension forces inside the binding wire and friction forces on the binding wire are reduced. Thereby, also risk for breaking the binding wire during the tying process is reduced. Further, the knot that will be created will get a lower height, than in the case with the previous known and described knot plate, because the binding wire is guided within the groves towards the aperture instead of extending above the knot plate towards the aperture.

Consequently, an improved knot plate is provided and thereby the above mentioned object is achieved.

According to some embodiments, each of the two grooves has a depth that corresponds to more than a half of a diameter of cross section of the binding wire.

Thereby it is ensured that the binding wire doesn't jump out from the two grooves when the binding wire is guided within the grooves towards the aperture during a tying process because upper edges of the two grooves will extend over more than a half of a diameter of cross section of the binding wire when the binding wire is guided within the grooves, which further improves the control of the movement of the binding wire during the tying process.

According to some embodiments, the two grooves comprise a first groove and a second groove, where the first groove is arranged along a first line and where the second groove is arranged along a second line, wherein the first line and the second line are displaced parallely in each direction in relation to a line through a middle of the two through slots and the middle of the knot plate.

Because the first groove is arranged along the first line and the second groove is arranged along the second line, the first grove ends in the aperture along the first line and the second grove ends in the aperture along the second line. Because the first line and the second line are displaced parallely in each direction in relation to a line through the middle of the two through slots and the middle of the knot plate, the two grooves end in the aperture along lines that are displaced in each direction in relation to the line through the middle of the two through slots and the middle of the knot plate. Consequently, the binding wire is guided during a tying process along the first groove and the second groove into said aperture so that the binding wire reaches the aperture in the end of the first groove and the second groove respectively at a distance on each side of the line through the middle of the two through slots and the middle of the knot plate. Thereby, the angle with which the binding wire is bended during the tying process is reduced, which results in that forces in the binding wire and friction forces on the binding wire will decrease during the tying process. Thus, an improved knot plate is obtained with further improved control of the movement of the binding wire towards the aperture of the knot plate during the tying process.

According to some embodiments, the aperture comprises a substantially circular form, wherein each of the two grooves ends in the aperture in a direction that coincides with substantially tangential directions of the aperture.

Because each of the two grooves ends in the aperture in a direction that coincides with substantially tangential directions of the aperture the binding wire will be guided from each groove towards the aperture in a respective direction that coincides with a respective tangential direction of the aperture. Thereby, the angle with which the binding wire is bended during the tying process is further reduced, which further will decrease forces in the binding wire and friction forces on the binding wire during the tying process. Thus, further improved knot plate is obtained with further improved control of the movement of the binding wire towards the aperture of the knot plate during the tying process. Thereby, a knot plate is obtained with which knot plate a tying may be performed in a simple and efficient manner.

According to some embodiments, the knot plate comprises a first side and a second side wherein the knot plate is arranged to be mounted in the tying machine so that the second side faces towards the tying machine and so that the first side faces from the tying machine, wherein the aperture and the two grooves are arranged in the first side of the knot plate.

According to some embodiments, the knot plate comprises an intended rotational direction, wherein each of the two through slots comprises a first surface that faces in the intended rotational direction and a second surface that faces against the intended rotational direction wherein the knot plate comprises edges between the first surface of each of the two through slots and the first side of the knot plate, wherein the edges comprise bevelled profiles.

Because the edges between the first surface that faces in the intended rotational direction of each of the two through slots and the first side of the knot plate comprises bevelled profiles, lower frictions between the binding wire and the edges occur during the tying process. Thereby, risk that the binding wire may break during the tying process is further reduced.

According to some embodiments the knot plate comprises groove edges in the transitions between each of the two grooves and one respective through slot of the two through slots, wherein the groove edges comprise bevelled groove edge profiles.

Thereby, in the transitions between each of the two grooves and one respective through slot of the two through slots lower friction will occur, which further reduce the risk for breaking the binding wire during the tying process. Further, an improved the control of the movement of the binding wire during the tying process is obtained. Thereby, a knot plate is obtained with which knot plate a tying may be performed in a simple and efficient manner.

According to further aspect, the object is achieved by a tying machine comprising a knot plate as described herein.

BRIEF DESCRIPTION OF THE DRAWINGS

The various aspects of the subject matter, including their particular features and advantages, will be readily understood from the following detailed description and the accompanying drawings, in which.

DETAILED DESCRIPTION

The embodiments herein will now be described in more detail with reference to the accompanying drawings, in which example embodiments are shown. Disclosed features of example embodiments may be combined. Like numbers refer to like elements throughout.

Figure 1:
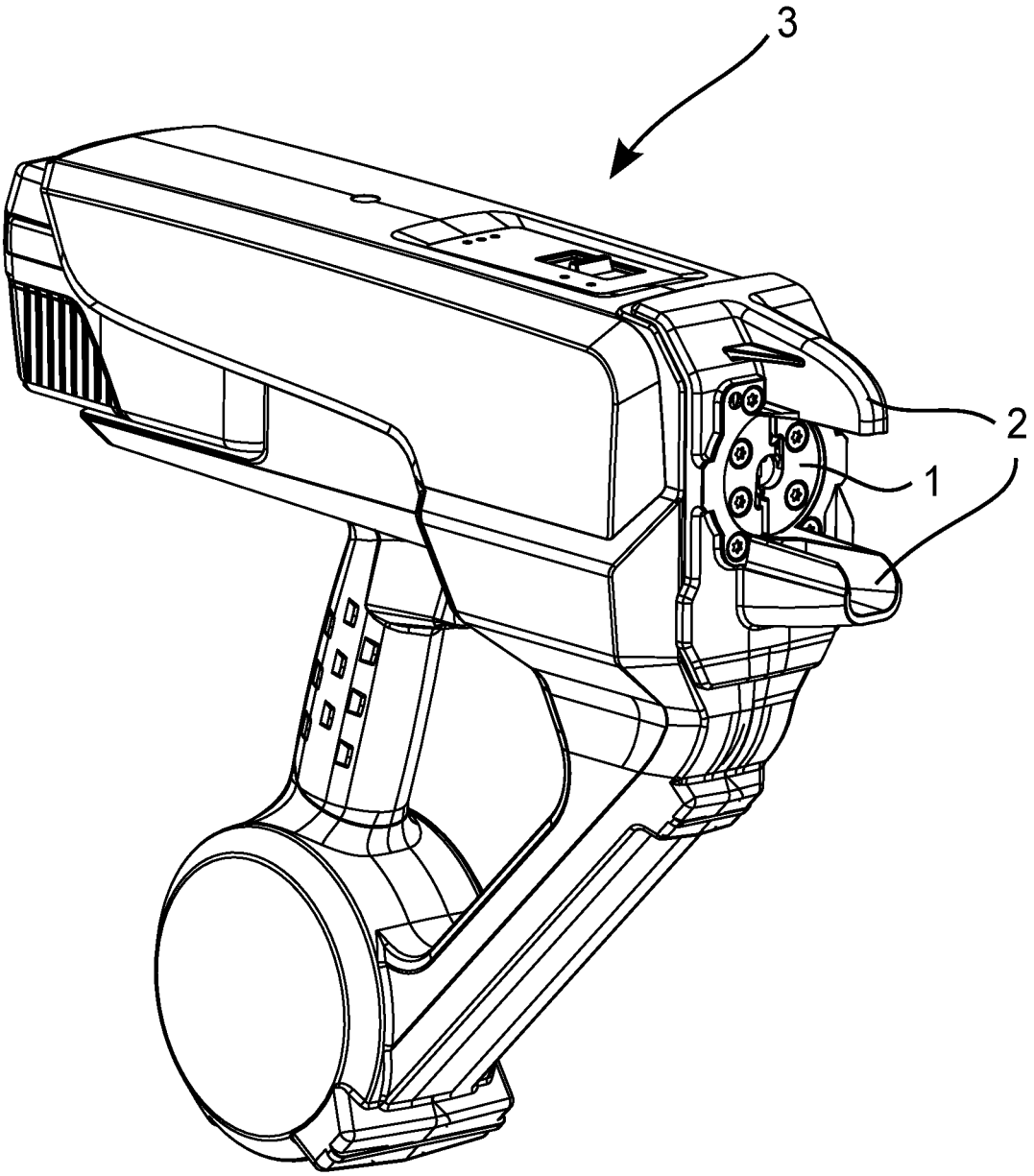
FIG. 1 shows a tying machine comprising a knot plate.

FIG. 1 shows a tying machine 3 comprising a knot plate 1 and two claws 2. The tying machine 3 comprises also a mechanism for feeding and for tightening of a binding wire, a mechanism for rotating the knot plate 1 and a mechanism for cutting ends of the binding wire. The mechanisms are of conventional type for tying machines and are not described in details herein.

As illustrated in FIG. 1, the knot plate 1 is arranged between the two claws 2. Each of the two claws 2 comprises a guiding surface. The two claws 2 are used for guiding a binding wire being fed by one of mechanisms of the tying machine 3 along the guiding surface of one of the claws and over to the other guiding surface of the other claw in order to bring the binding wire around objects (not shown) that are intended to be bound with the binding wire. The knot plate 1 comprises two through slots. The knot plate 1 is positioned so that the through slots point in a direction towards the claws 2. The binding wire is tightened with a certain force after that the binding wire has been brought around the objects. The binding wire is then brought into the two through slots. After that the tying machine 3 rotates the knot plate 1 to form a knot in the middle of the knot plate 1. During or after the rotation of the knot plate 1, when a knot has been formed, the tying machine cuts ends of the binding wire. Thereby, a tying is formed comprising a knot around the objects.

Figure 2:
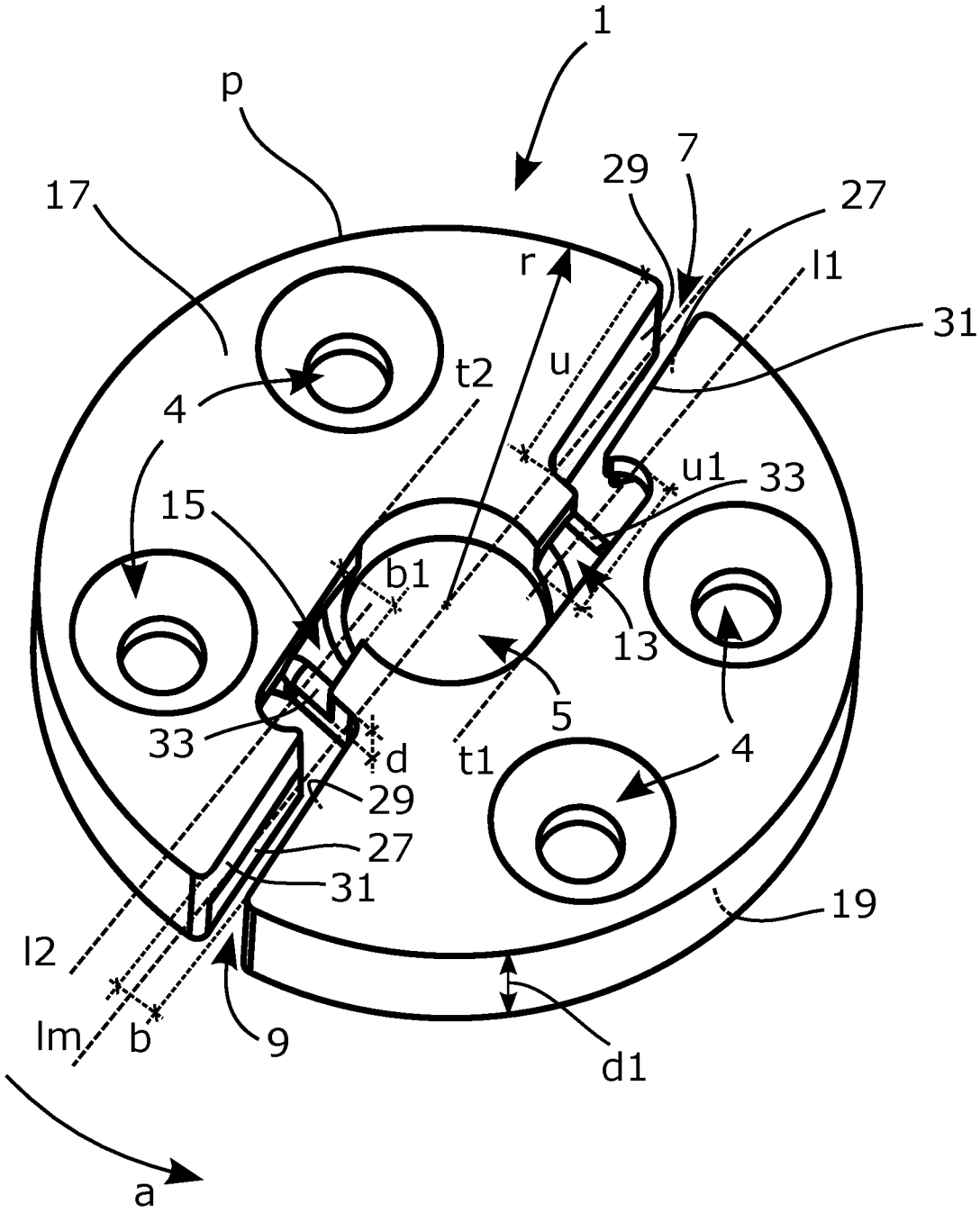
FIG. 2 shows a knot plate illustrated in FIG. 1 where one aperture, two grooves and two slots are illustrated, wherein the aperture and the two grooves are arranged on a first side of the knot plate

FIG. 2 shows the knot plate illustrated in FIG. 1. As shown in FIG. 2, the knot plate 1 is designed as a substantially circular disc comprising holes 4 for receiving fastening elements such as screws or bolts for fastening of the knot plate 1 to the tying machine. According to embodiments illustrated in FIG. 2, the knot plate comprises four holes 4. However, the knot plate 1 may comprise another number of holes for receiving the fastening elements. Further, the knot plate 1 comprises an aperture 5 arranged substantially in the middle of the knot plate 1 and two through slots 7, 9 for receiving a binding wire, the through slots 7, 9 being arranged in the knot plate 1 substantially on opposite sides of each other in relation to the aperture 5.

As illustrated in FIG. 2, the two through slots 7, 9 extend from a periphery p of the knot plate towards the aperture 5. Thereby, the binding wire may be guided into the two through slots 7, 9 during the initial phase of the tying process when the binding wire is tightened. According to other embodiments, the two through slots 7, 9 may be configured as through holes in the knot plate 1 that do not extend out to the periphery p of the knot plate. In such embodiments the binding wire id guided through the through holes before the binding wire is tightened.

The two through slots 7, 9 have a width b that corresponds to more than a diameter of cross section of the binding wire. The diameter of cross section of a conventional binding wire is approximately one and a half millimetre (1.5 mm). The diameter of cross section of the binding wire may also be from approximately 0.5 mm to approximately 5 mm. Further, the two through slots 7, 9 have an extension u which in the example shown in FIG. 2 is approximately 50% of a radius r of the knot plate 1. The extension u may in other embodiments be in a range approximately 30%-70% of the radius r of the knot plate 1. The radius r of the knot plate 1 may be in a range from approximately 10 mm to approximately 70 mm.

As illustrated in FIG. 2 the knot plate 1 comprises two grooves 13, 15 for receiving the binding wire, wherein each of the two grooves 13, 15 connects one respective through slot 7, 9 of the two through slots 7, 9 with the aperture 5. Thus, the two grooves 13, 15 are arranged to receive the binding wire. Thereby, the binding wire will be guided into the grooves 13, 15 towards the aperture 5 during rotation of the knot plate during a tying process. Because the binding wire is guided into the grooves 13, 15 during the tying process, instead for extending over the knot plate 1 as in the case with the previous known and described knot plate, both tension forces inside the binding wire and friction forces on the binding wire are reduced. Thereby, also risk for breaking the binding wire during the tying process is reduced. Further, the knot that will be created will get a lower height, than in the case with the previous known and described knot plate, because the binding wire is guided within the groves 13, 15 towards the aperture 5 instead of extending above the knot plate 1 towards the aperture 5 and therefore will be wrapped around the knot at a shorter distance from the object to be bonded with the binding wire than in the case with the previous known and described knot plate.

The two grooves 13, 15 each comprise a depth d that corresponds to more than a half of a diameter of cross section of the binding wire. Thereby, the upper edges of the two grooves 13, 15 will extend over more than a half of the diameter of cross section of the binding wire which will ensure that the binding wire will not jump out from the two grooves 13, 15 when the binding wire is guided within the grooves towards the aperture 5 during a tying process. Further, because the two grooves 13, 15 each comprise a depth d that corresponds to more than a half of a diameter of cross section of the binding wire it is also ensured that the knot will get a lower height.

The knot plate 1 has a thickness d1, which thickness d1 may be in a range from approximately 2 mm to approximately 30 mm. According to embodiments illustrated in FIG. 2, the depth d of the two grooves 13, 15 is approximately 50% of the thickness d1 of the knot plate 1.

In the example illustrated in FIG. 2 the knot plate 1 comprises a first side 17 and a second side 19, wherein the knot plate 1 is arranged to be mounted in the tying machine so that the second side 19 faces towards the tying machine and so that the first side 17 faces from the tying machine, wherein the aperture 5 and the two grooves 13, 15 are arranged in the first side 17 of said knot plate 1.

According to embodiments illustrated in FIG. 2, the aperture 5 is arranged as a through hole in the knot plate 1. According to other embodiments the aperture 5 may be arranged as a recess in the knot plate 1 with a depth that is less than the thickness d1 of the knot plate 1 and that is equal or greater than the depth d of the two grooves 13, 15.

The two grooves 13, 15 have a width b1 that substantially corresponds to the width b of the two through slots 7, 9 and that is greater than a diameter of cross section of the binding wire. Further, the two grooves 13, 15 have an extension u1 that, in the example shown in FIG. 2 is approximately 35% of the radius r of the knot plate. The extension u1 may in other embodiments be in a range of approximately 10%-70% of the radius of the knot plate 1.

The knot plate 1 has an intended rotational direction a, which in the embodiments illustrated in FIG. 2 corresponds to a counter-clockwise rotational direction. In the embodiments shown in the figure the two grooves 13, 15 comprise a first groove 13 and a second groove 15, where the first groove 13 is arranged along a first line I1 and where the second groove 15 is arranged along a second line I2, wherein the first line I1 and the second line I2 are displaced parallely in each direction in relation to a line Im through the middle of the two through slots 7, 9 and the middle of the knot plate 1. As illustrated in FIG. 2, the first line I1 and the second line I2 are both displaced in a direction against the intended rotational direction a of the knot plate 1. Consequently, the binding wire is guided during a tying process along the first groove 13 and the second groove 15 into the aperture 15 so that the binding wire reaches the aperture 5 in the end of the first groove 13 and the second groove 15 respectively at a distance on each side of the line Im through the middle of the two through slots 7, 9 and the middle of the knot plate 1. Thereby, the angle with which the binding wire is bended during the tying process is reduced. This result in that, the forces in the binding wire and friction forces on the binding wire will decrease during the tying process.

The first line I1 and the second line I2, along which the first groove 13 respective the second groove 15 are arranged, are each displaced parallely from the line Im through the middle of the two through slots 7, 9 and the middle of the knot plate 1 with a distance that corresponds substantially to the width b1 of the two grooves 13, 15. Thereby, an improved knot plate 1 is obtained with further improved control of the movement of the binding wire towards the aperture 5 of the knot plate 1 during a tying process.

As illustrated in FIG. 2, the two grooves 13, 15 are arranged as substantially straight grooves along the first line I1 and the second line I2 respectively.

According to some embodiments, the two grooves 13, 15 are arranged substantially along the line Im through the middle of the two through slots 7, 9 and the middle of the knot plate 1. Thereby, manufacturing of the knot plate may be simplified because, the two grooves 13, 15 may be arranged substantially along the line Im through the middle of the two through slots 7, 9 of the knot plate 1.

The two grooves 13, 15 may have a curvature, for example in a form of a semicircle.

According to the embodiment illustrated in FIG. 2, each of two through slots 7, 9 has a respective curvature, wherein each of the curvatures are arranged in a direction towards the first line I1 and towards the second line I2 respectively. Thus, the two slots 7, 9 may have an L-form or a substantially L-form. Consequently, the curvatures permit that the binding wire is guided into the two grooves 13, 15 towards the aperture 5 during that the binding wire is bent with a greater radius of curvature than if the two through slots 7, 9 did not have curvatures. Thereby, forces inside the binding wire and friction forces on the binding wire during the tying process are reduced.

As illustrated in FIG. 2 the aperture 5 may comprise a substantially circular form, wherein each of the two grooves 13, 15 ends in the aperture 5 in a direction that coincides with substantially tangential directions t1 and t2 respectively of the aperture 5. Thereby it is ensured that the angle with which the binding wire is bent during the tying process is small. In other embodiments the aperture 5 may have for example a hexagonal-form. Also according to such embodiment may each of the two grooves 13, 15 is ending in the aperture in a direction that substantially coincides with a direction of a wall of the aperture, for example the wall of an aperture with hexagonal-form.

According to the embodiments illustrated in FIG. 2, the two through slots 7, 9 comprise a first surface 27 that faces in the intended rotational direction a and a second surface 29 that faces against the intended rotational direction a wherein the first surface 27 and the second surface 29 define the two through slots 7, 9. The knot plate 1 comprises edges 31 between the first surface 27 of each of the two through slots 7, 9 and the first side 17 of the knot plate 1, wherein the edges 31 comprise bevelled profiles. Because the edges 31 between the first surface 27 that faces in the intended rotational direction a of each of the two through slots 7, 9 and the first side 17 of the knot plate 1 comprises bevelled profiles, lower frictions between the binding wire and the edges 31 occur during the tying process when the binding wire is guided from the two slots 7, 9 towards the two grooves 13, 15. Thereby, risk that the binding wire will break during the tying process is further reduced.

As illustrated in FIG. 2, the knot plate 1 comprises groove edges 33 in the transitions between each of the two grooves 13, 15 and one respective through slot 7, 9 of the two through slots 7, 9, wherein the groove edges 33 comprises bevelled groove edge profiles. Thereby, in the transitions between each of the two grooves 13, 15 and one respective through slot 7, 9 of the two through slots 7, 9 lower friction will occur, which further reduce the risk for breaking the binding wire during the tying process.

Figure 3:
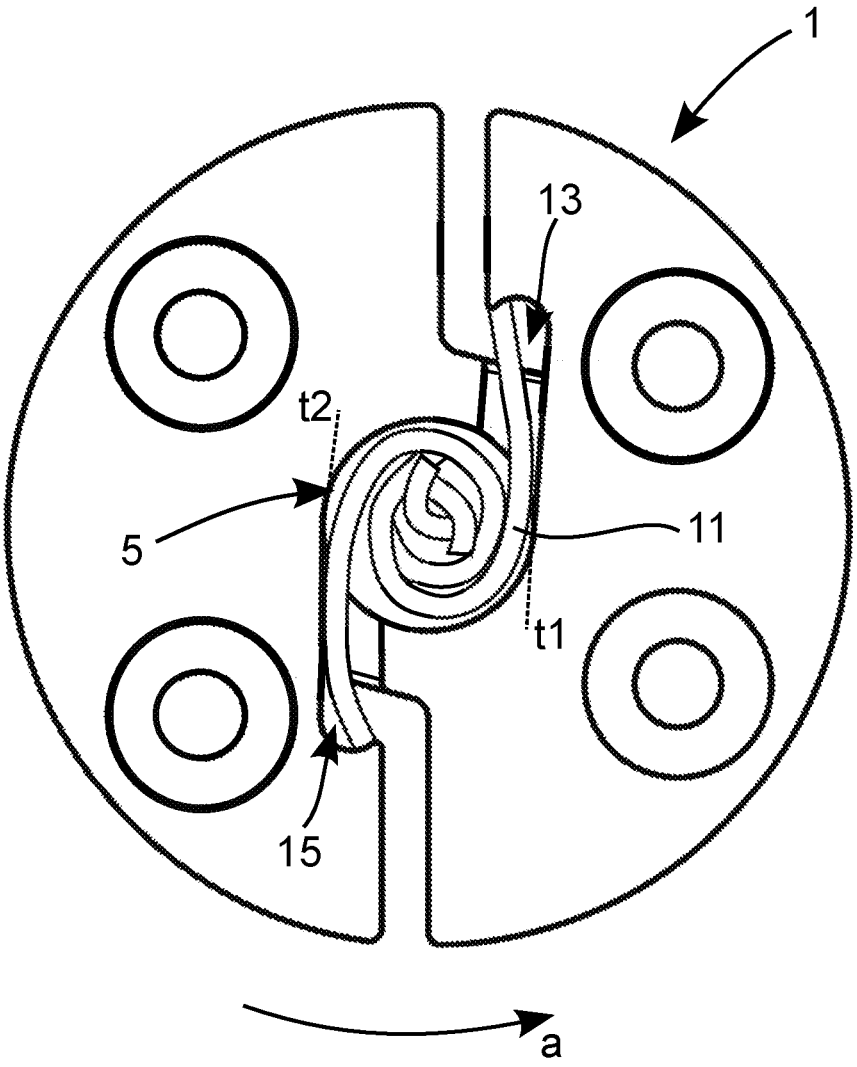
FIG. 3 shows the knot plate illustrated in FIG. 1 and FIG. 2 with a binding wire illustrated in the knot plate.

In FIG. 3, the knot plate 1 shown in FIG. 2 is illustrated with a binding wire 11 that is forming a knot in the aperture 5 in the middle of the knot plate 1. This, after a completed tying process. As illustrated in FIG. 3, the binding wire 11 is guided along the first groove 13 and the other groove 15 into the aperture 5 so that the binding wire 11 has reached the aperture 5 in the ends of the first groove 13 and the second groove 15 respectively in a direction that coincides with substantially tangential directions t1 and t2 of the aperture 5. As illustrated in FIG. 3, the binding wire has initially substantially followed the wall of the aperture 5 and later has been moved inwards the aperture 5 during rotation of the knot plate 1 in the intended rotational direction a. As illustrated in FIG. 3 the angle with which the binding wire 11 has been bent during the tying process is small comparing to tying with a traditional tying machine where the binding wire is wrapped around over the knot plate. Thereby, forces inside the binding wire and friction forces on the binding wire are reduced during the tying process. The knot that is created with the knot plate 1 has been created in the aperture 5 and has got a lower height, than in the case with the previous known and described knot plate, because the binding wire is guided within the groves 13, 15 towards the aperture 5 instead of extending above the knot plate 1 towards the aperture 5 and therefore will be wrapped around the knot at a shorter distance from the object to be bonded with the binding wire than in the case with the previous known and described knot plate.

The knot that is created with the knot plate may also be called a winding, i.e. a winding for connecting of two ends of a binding wire.

According to further embodiments of the knot plate 1, the second side 19 is arranged in a similar way or identically as the first side 17 of the knot plate 1 according to FIG. 2. In more details, the second side 19 of the knot plate comprises a second aperture arranged substantially in the middle of the knot plate and two other grooves for receiving of the binding wire, wherein each of the two other grooves connects one respective through slot of the two through slots 7, 9 with the second aperture. Thereby, the knot plate 1 may also be mounted in the tying machine so that the first side 17 faces towards the tying machine and so that the second side 19 faces from the tying machine. Thus, a reversible knot plate is obtained where both the first side 17 and the second side 19 may be used for tying, which gives the knot plate an improved life span.

The second side 19 of the knot plate may comprise one or several of the above mentioned features from the first side 17 of the knot plate 1. According to the embodiment of the knot plate 1 as illustrated in FIG. 2 when the second side is used for tying, the knot plate 1 is rotating in a second rotational direction which corresponds to a clockwise rotational direction.

The second aperture may be arranged as a through hole in the knot plate 1. According to other embodiments the second aperture may be arranged as a recess in the knot plate with a depth that is less than a thickness of the knot plate 1 and that is equal or greater than the depth of the two grooves. In embodiments when the second aperture is arranged as a through hole, the second aperture is the same as the aperture 5 shown in FIG. 2.

Because the two through slots 7, 9 are through, they work in the same way no matter if the first side 17 of the knot plate 1 or the second side 19 of the knot plate is used.

The invention claimed is:

1. A knot plate for a tying machine, said knot plate comprising:

a substantially circular disc;

an aperture arranged substantially in the middle of said disc, wherein the aperture comprises a substantially circular form;

two through slots arranged in said disc and configured to receive a binding wire, each of said two through slots being disposed substantially on opposite sides of said aperture and each of said two through slots comprising an opening that extends axially through the disc; and two grooves configured to receive said binding wire, wherein each of said two grooves connects one respective through slot of said two through slots with said aperture;

wherein each of said two grooves ends in said aperture in a substantially tangential direction to said aperture such that the binding wire initially substantially follows a wall of the aperture.

2. The knot plate according to claim 1, wherein said two grooves each has a depth that corresponds to more than a half of a diameter of a cross section of said binding wire.

3. The knot plate according to claim 1, wherein said two grooves comprise a first groove and a second groove, where said first groove is arranged along a first line and where the second groove is arranged along a second line, wherein said first line and said second line are displaced parallelly in each direction in relation to a line through a middle of said two through slots and a middle of said knot plate.

4. The knot plate according to claim 1, wherein said knot plate comprises a first side and a second side, wherein said knot plate is arranged to be mounted in said tying machine so that said second side faces towards said tying machine and so that said first side faces from said tying machine, wherein said aperture and said two grooves are arranged in said first side of said knot plate.

5. The knot plate according to claim 4, where said knot plate comprises an intended rotational direction, wherein each of said two through slots comprises a first surface that faces in said intended rotational direction and a second surface that faces against said intended rotational direction wherein said knot plate comprises edges between said first surface of each of said two through slots and said first side of said knot plate, wherein said edges comprise bevelled profiles.

6. The knot plate according to claim 1, wherein said knot plate comprises groove edges in the transitions between each of said two grooves and one respective through slot of said two through slots, wherein said groove edges comprises bevelled groove edge profiles.

7. A tying machine comprising:

two claws coupled to a housing;

a knot plate coupled to the housing; and a mechanism for rotating the knot plate;

wherein the knot plate comprises:

a substantially circular disc;

an aperture arranged substantially in the middle of said disc, wherein the aperture comprises a substantially circular form;

two through slots arranged in said disc and configured to receive a binding wire guided by guide surfaces of the two claws into the two through slots, each of said two through slots being disposed substantially on opposite sides of said aperture and each of said two through slots comprising an opening that extends axially through the disc; and two grooves configured to receive said binding wire, wherein each of said two grooves connects one respective through slot of said two through slots with said aperture;

wherein each of said two grooves ends in said aperture in a substantially tangential direction to said aperture such that the binding wire initially substantially follows a wall of the aperture.

8. The tying machine according to claim 7, wherein said two grooves each has a depth that corresponds to more than a half of a diameter of cross section of said binding wire.

9. The tying machine according to claim 7, wherein said two grooves comprise a first groove and a second groove, where said first groove is arranged along a first line and where the second groove is arranged along a second line, wherein said first line and said second line are displaced parallelly in each direction in relation to a line through a middle of said two through slots and a middle of said knot plate.

10. The tying machine according to claim 7, wherein said knot plate comprises a first side and a second side, wherein said knot plate is arranged to be mounted in said tying machine so that said second side faces towards said tying machine and so that said first side faces from said tying machine, wherein said aperture and said two grooves are arranged in said first side of said knot plate.

11. The tying machine according to claim 10, where said knot plate comprises an intended rotational direction, wherein each of said two through slots comprises a first surface that faces in said intended rotational direction and a second surface that faces against said intended rotational direction wherein said knot plate comprises edges between said first surface of each of said two through slots and said first side of said knot plate, wherein said edges comprise beveled profiles.

12. The tying machine according to claim 7, wherein said knot plate comprises groove edges in the transitions between each of said two grooves and one respective through slot of said two through slots, wherein said groove edges comprises beveled groove edge profiles.

13. The knot plate according to claim 1, wherein each of the through slots further extend radially to a periphery of the substantially circular disc from a respective groove of the two grooves.

* * * * *